US007802328B2

(12) United States Patent
Lingegard

(10) Patent No.: US 7,802,328 B2
(45) Date of Patent: Sep. 28, 2010

(54) HOIST DEVICE WITH SLING ATTACHMENT DETECTION

(75) Inventor: Hans Lingegard, Eslov (SE)

(73) Assignee: Huntleigh Technology Limited (GB)

( * ) Notice: Subject to any disclaimer, the term of this patent is extended or adjusted under 35 U.S.C. 154(b) by 0 days.

(21) Appl. No.: 12/307,672

(22) PCT Filed: Jul. 5, 2007

(86) PCT No.: PCT/IB2007/002868

§ 371 (c)(1),
(2), (4) Date: Jan. 23, 2009

(87) PCT Pub. No.: WO2008/007222

PCT Pub. Date: Jan. 17, 2008

(65) Prior Publication Data

US 2009/0307840 A1 Dec. 17, 2009

(51) Int. Cl.
*A61G 7/10* (2006.01)

(52) U.S. Cl. ..... 5/83.1; 5/87.1; 5/89.1; 5/424

(58) Field of Classification Search ..... 5/81.1 R–89.1, 5/424; 414/921
See application file for complete search history.

(56) References Cited

U.S. PATENT DOCUMENTS

| | | | |
|---|---|---|---|
| 5,809,591 | A * | 9/1998 | Capaldi et al. |
| 6,289,534 | B1 * | 9/2001 | Hakamiun et al. |
| 6,557,189 | B2 | 5/2003 | Von Schroeter |
| 7,331,071 | B1 * | 2/2008 | Cherubini et al. |
| 2006/0080774 | A1 * | 4/2006 | McWattie et al. |

FOREIGN PATENT DOCUMENTS

| | | |
|---|---|---|
| EP | 1 088 539 A | 4/2001 |
| JP | 2005 111113 A | 4/2005 |

* cited by examiner

*Primary Examiner*—Michael Trettel
(74) *Attorney, Agent, or Firm*—Craig A. Fieschko, Esq.; DeWitt Ross & Stevens S.C.

(57) ABSTRACT

A hoist device for lifting persons, said hoist device comprising holding means (27); and a hoist sling comprising attachment means (37), said attachment means (37) being connectable to the holding means (27). Any of the attachment means (37) and the holding means (27) comprises a reference object (8), and any of the attachment means (37) and the holding means (27) comprises sensing means (7) configured to detect the reference object (8), for determining if the attachment means (37) are properly connected to the holding means (27).

20 Claims, 4 Drawing Sheets

HOIST DEVICE WITH SLING ATTACHMENT DETECTION

TECHNICAL FIELD

The present invention relates to a hoist device for lifting persons. The hoist device comprises a sling hanger with holding means, and a hoist sling comprising attachment means connectable to the holding means.

BACKGROUND ART

Hoist devices are commonly used in health and care institutions for lifting particularly, but not necessarily exclusively disabled persons.

Typically the hoist device comprises a lifting column mounted on a chassis. Attached to the lifting column is a movable lifting arm which at its outer end has a sling hanger support. The person to be lifted is usually placed in a hoist sling and attachment means of the hoist sling are then connected to the sling hanger support.

To prevent accidents, such as a patient falling out of the hoist sling, it is important that the hoist sling is correctly connected to the hanger support when the patient is lifted. Moreover, it is important that the connection between the hoist sling and the hanger support is maintained, even if the patient moves considerably or suffers from spasms.

However, the connection between the hoist sling and its hanger support is occasionally and unintentionally incorrect or lost. To prevent this from happening or at least reduce the risk of it, solutions are provided for ensuring a correct and maintained connection.

JP-A-2005111113 discloses one way of ensuring proper connection between a hoist sling and a sling hanger support, which is accomplished by tension sensors arranged on the sling hanger support. More specifically, the sensors are positioned on the supporting part of four hooks belonging to the sling hanger support. During lifting, four straps of the hoist sling are located in associated hooks. Once a patient is lifted, each sensor detects a pressure applied by the corresponding strap and if at least one of the sensors does not detect any pressure, an error-signal is sent to the operator of the hoist device, allowing the lifting operation to be stopped and the straps to be correctly positioned.

U.S. Pat. No. 6,557,189 discloses another hoist device for lifting persons. However, no specific means for ensuring and verifying proper connection of a hoist sling is described.

A general problem with existing hoist devices for persons is that they do not ensure in a sufficient manner that the hoist sling is properly attached to its associated sling hanger.

SUMMARY OF THE INVENTION

It is an object of the present invention to provide an improvement to the above techniques and prior art.

A particular object is to provide means for reducing the risk of a patient falling out of a hoist sling attached to a sling hanger.

These and other objects are advantages that will be apparent from the following description of the present invention are achieved by a hoist device, attachment means, hoist sling, kit of parts and method according to the respective independent claims. Preferred embodiments are defined in the dependent claims.

Hence, a hoist device for lifting persons is provided, said hoist device comprising holding means and a hoist sling comprising attachment means, said attachment means being connectable to the holding means. Any of the attachment means and the holding means comprises a reference object, and any of the attachment means and the holding means comprises sensing means configured to detect the reference object, for determining whether the attachment means are properly connected to the holding means.

The inventive hoist device is advantageous in that correct attachment of the hoist sling to the sling hanger is actively verified, independently of the lifting status of the hoist device. Thus, it will be detected if a carer forgets to connect the attachment means or if the attachment means are incorrectly connected to the holding means.

The hoist device may comprise a control unit configured to determine whether the attachment means are properly connected to the holding means.

The control unit may be configured to provide a specific status signal, before any lifting operation is commenced, if the attachment means are properly connected to the holding means, which is advantageous in that accidents are further avoided if no lifting operation begins before correct connection is ensured.

The control unit may be configured to provide a specific status signal, during a lifting operation, if the attachment means are improperly connected to the holding means, which is advantageous in that a carer will be warned if, for example, a spastic patient causes the attachment means to be disconnected from its holding means.

The hoist sling may comprise a plurality of attachment means which comprise reference objects, and the hoist device may comprise a plurality of holding means which comprise sensing means configured to detect said reference objects, said control unit being configured to provide a specific status signal, when all attachment means comprising reference objects are properly connected to the holding means, which facilitates versatile implementation of the invention.

The sensing means may be arranged at the holding means in a first specific position, and the reference object may be arranged at any of the attachment means and the holding means in a second specific position, such that the sensing means detect the reference object only if the attachment means have a specific relative position in relation to the holding means, which facilitates a practical implementation of the invention.

The attachment means may comprise a first material and said reference object may comprise a second material different from said first material, for improving detection by the sensing means of the reference object.

The attachment means may comprise a plate-like clip, which provides for very cost-efficient and user-friendly attachment means.

The attachment means may be made of plastics and/or metal, and the reference object may be fastened to the attachment means, for providing further cost-efficient attachment means incorporating a reference object.

The attachment means may comprise a loop of a strap and the reference object may be attached to the loop, for allowing a cost-efficient design of the attachment means.

The reference object may comprise a magnet and the sensing means may comprise a magnetic field sensor. Optionally the reference object comprises a reflective material and the sensing means comprises a light emitter and a light sensor.

According to another aspect of the invention, attachment means are provided for use in a hoist device which incorporates any of the features described above.

According to yet another aspect of the invention, a hoist sling is provided for use in a hoist device which incorporates any of the features described above.

According to still another aspect of the invention, a kit of parts is provided for a hoist device for persons, said kit comprising: a reference object configured to be attached to any of the attachment means and the holding means of the hoist device; and Sensing means configured to be attached to holding means of the hoist device, said sensing means being configured to detect the reference object, for determining if the attachment means are properly connected to the holding means.

The inventive kit of parts may incorporate any of the relevant features described above in association with the inventive hoist device, such as a control unit in communication with the sensing means, for determining whether the attachment means are properly connected to the holding means. The kit of parts has the same advantages as the inventive hoist device.

According to still another aspect of the invention a method is provided of securing a hoist sling to a hoist device for persons, said method comprising the steps of: connecting attachment means of the hoist sling to holding means of the hoist device, and verifying that reference objects of any of the attachment means and the holding means are detected by sensing means of the holding means, for determining whether the attachment means are properly connected to the holding means.

Of course, the hoist device of the securing method may incorporate any of the features described above in association with the inventive hoist device, and the inventive method has the same advantages as the inventive hoist device. In particular the step of verification may be performed before any hoisting is commenced.

It should be noted that the interpretation of the expression "any of the attachment means and the holding means" includes the interpretation "any one of the attachment means and the holding means" as well as the interpretation "both the attachment means and the holding means".

BRIEF DESCRIPTION OF THE DRAWINGS

Embodiments of the present invention will now be described, by way of example, with reference to the accompanying schematic drawings, in which.

DETAILED DESCRIPTION OF EMBODIMENTS

Figure 1:
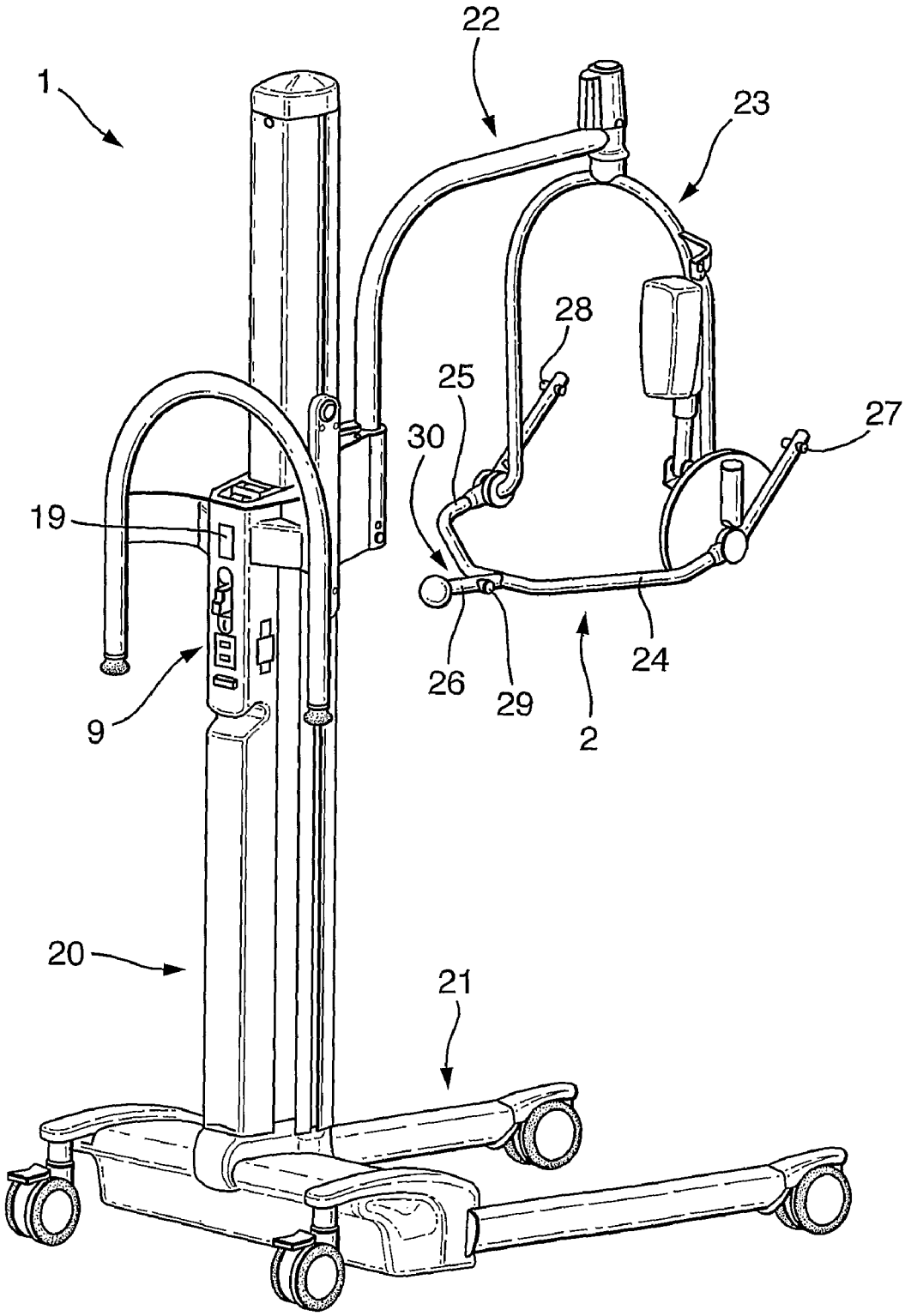
FIG. 1 is a perspective view of a hoist device.
Figure 2:
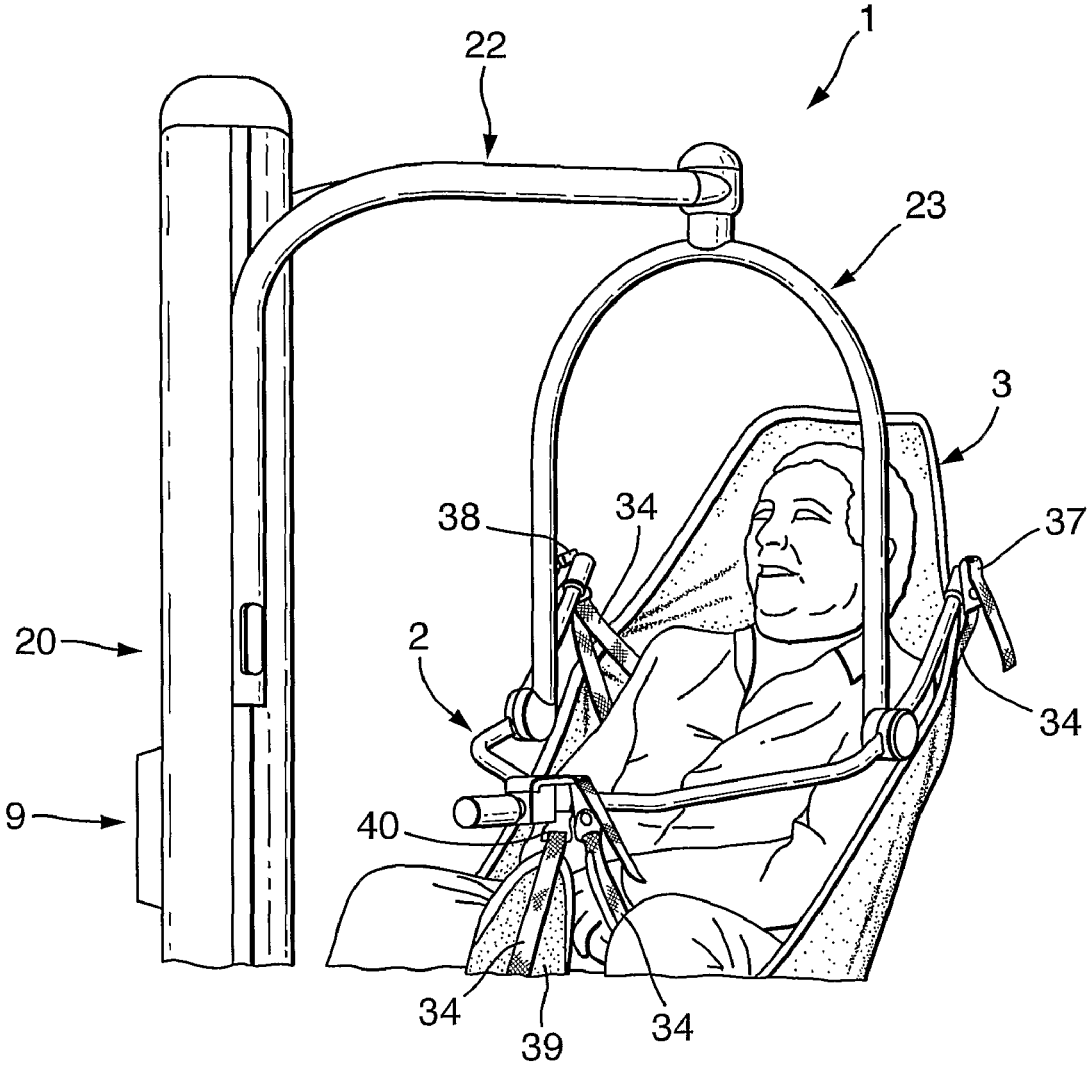
FIG. 2 is a partial perspective view of a hoist device according to the invention.
Figure 3:
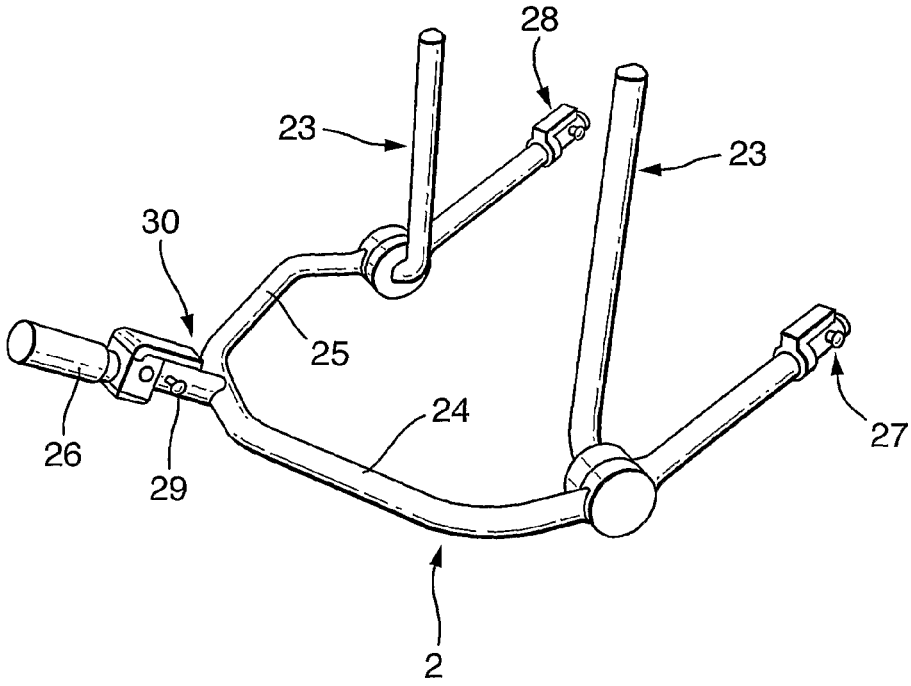
FIG. 3 is a perspective view of a sling hanger according to the first embodiment.

With reference to FIGS. 1, 2 and 3, a hoist device 1 for disabled persons comprises a support structure, which includes a chassis 21, a vertical lifting column 20 upstanding from the chassis 21, a vertically movable lifting arm 22 projecting from the lifting column 20, a sling hanger support 23 arranged at the free or outer end of the lifting arm 22, and a lifting element which has the form of a sling hanger 2 supported by the sling hanger support 23.

The lifting column 20 has a motor driven actuator (not shown) for raising and lowering the lifting arm 22, and a rechargeable battery (not shown) is mounted in the lifting column 20 and powers the motor driven actuator. The sling hanger support 23 has the form of an inverted U-shaped member which is mounted at the free outer end of the lifting arm 22 and is turnable about a substantially vertical axis.

It should be noted that the lifting arm 22 may be directly attached to a wall or ceiling mounting (not shown) having a functionality corresponding to that of the described lifting column 20. In this case, a lifting operation does not necessarily involve transportation, but merely hoisting of a person.

The sling hanger 2 has generally a U-shaped form and comprises two limbs 24, 25 which are pivotally connected to the respective lower ends of the sling hanger support 23, for allowing movement about a horizontal axis. The sling hanger 2 also has a central arm 26 extending from the base of the U-shaped sling hanger 2.

Holding means 27 and 28 in the form of headed studs are provided at the free ends of the limbs 24 and 25, and two further holding means 29 and 30, also in the form of headed studs, are provided on opposite sides of the central arm 26.

The hoist device 1 comprises a hoist sling 3 provided with four straps 34 made of a synthetic fiber. Each strap 34 is connected to a respective attachment means 37, 38, 39, 40 and each attachment means 37, 38, 39, 40 are connected, during a lifting operation, to a respective one of the above described holding means 27, 28, 29, 30.

Figure 4:
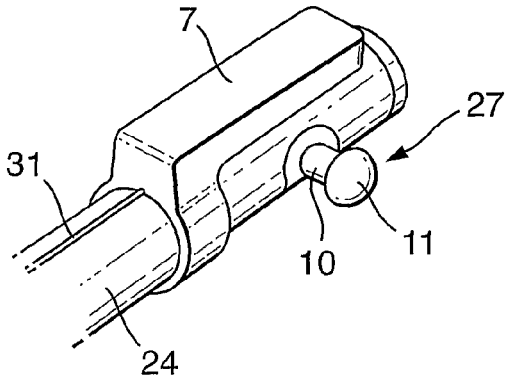
FIG. 4 is a perspective view of holding means according to a first embodiment.

With reference to FIG. 4, one of the holding means 27 are illustrated having the form of a headed stud 10 horizontally protruding from the above mentioned limb 24. Sensing means 7, for example in the form of a magnetic field sensor, are located adjacent the holding means 27 and have a specific detection area in relation to the location of the headed stud 10. A cable 31 runs from the sensing means 7 via the sling hanger 2, the sling hanger support 23 and the lifting arm 22, and connects the sensing means 7 to a control unit 9 arranged in the lifting column 20. Hence, the sensing means 7 are in communication with the control unit 9.

Corresponding sensing means are in a similar manner arranged adjacent the other previously described holding means 28, 29 and 30, and all sensing means are connected to the control unit 9.

Figure 5:
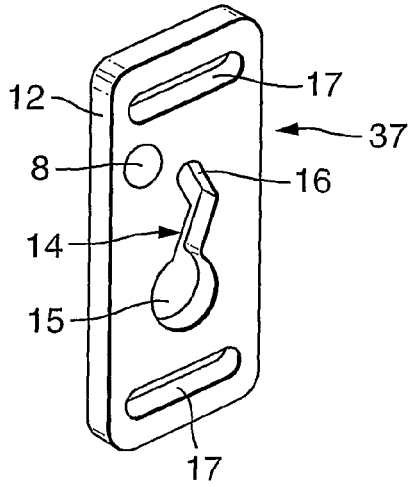
FIG. 5 is a perspective view of attachment means according to a first embodiment.

With reference to FIG. 5, one of the attachment means 37 is illustrated having the form a plate-like clip 12 with a slot 14 comprising a first lower portion 15 through which the head 11 of the stud 10 will pass and a second upper portion 16 through which the head 11 of the stud 10 will not pass. The clip 12 is preferably made of molded plastics and embedded therein is a reference object 8, for example in the form of a magnet, which is located proximate the second portion 16 of the slot 14. The clip 12 also comprises additional slots 17 in which a strap 34 of the hoist sling 3 is attached.

During a lifting operation, the attachment means 37 are connected to the holding means 27 by letting the stud 10 pass through the first slot portion 15, and by letting the clip 12 slide down so that the stud 10 is positioned in the second slot portion 16. After this connection the attachment means 37 has a specific position in relation to the holding means 27, which results in the reference object 8 having a specific position within the detection area of the sensing means 7.

Of course, the sensing means 7 and the reference object 8 are configured such that the sensing means 7 detect the reference object 8, when the attachment means 37 are properly connected to the holding means 27 as described above. When the sensing means 7 detects the reference object 8, the detection is registered by the control unit 9. Preferably, the sensing means 7 regularly provide a signal indicating detection of the reference object 8, as long as the attachment means 37 are properly connected. The regular signal may be continuous or intermittent.

In other words, in combination each attachment means 37, 38, 39, 40 and its corresponding holding means 27, 28, 29, 30 comprise communication means, the communication means comprising sensing means 7 and a reference object 8.

All attachment means 37, 38, 39, 40 and holding means 27, 28, 29, 30 are respectively configured and connected as described above, and each sensing means of respective holding means 27, 28, 29, 30 send a signal to the control unit 9 indicating the detection of a respective reference object.

The control unit 9 comprises software configured to register when any number of reference objects 8 is detected, and hence the control unit 9 is able to determine, or ensure, that all attachment means 37, 38, 39, 40 are correctly connected. When all attachment means 37, 38, 39, 40 are properly connected the control unit 9 provides a signal indicating that proper connection is achieved. Typically a sound signal and/or a visual signal is provided by indicating means 19 arranged at the column 20 and being in communication with the control unit 9. The control unit 9 may be configured to prevent lifting of the arm 22 if at least one, but not all four attachment means is properly connected.

Preferably, the control unit 9 is configured to provide a warning signal if one of the involved reference objects is no longer detected during a lifting operation.

Figure 6:
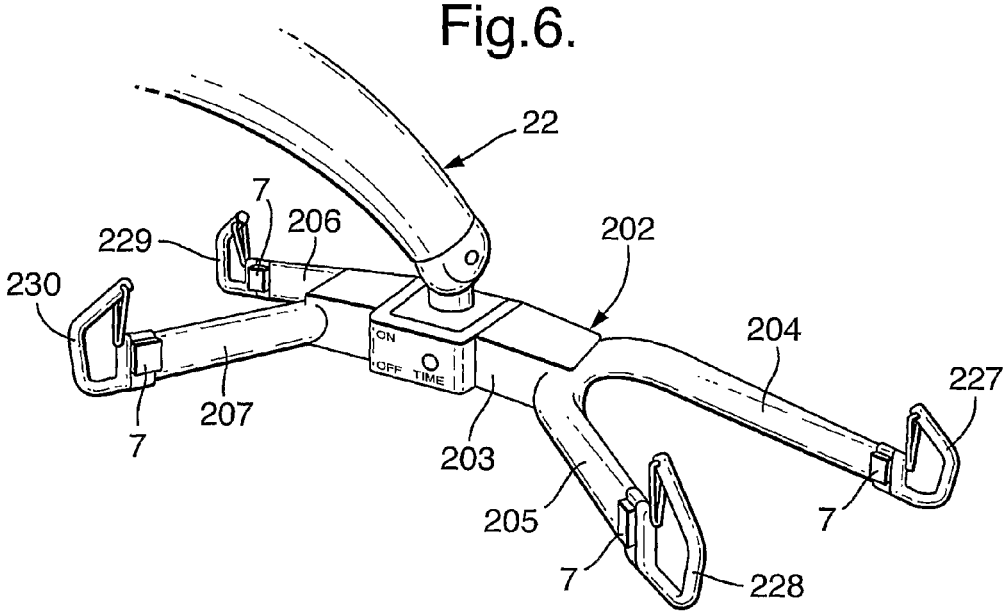
FIG. 6 is a perspective view of a sling hanger according to a second embodiment.
Figure 7:
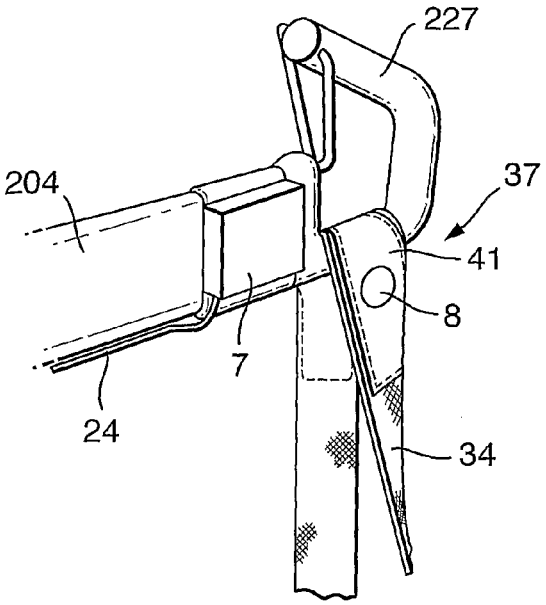
FIG. 7 is a perspective view of attachment means and holding means according to a second embodiment.

With reference to FIGS. 6 and 7, a second embodiment of a sling hanger 202 is illustrated which comprises a base 203 pivotably connected to the hoist arm 22 and having four arms 204, 205, 206, 207 extending from the base 203. Each arm has a respective holding means, or hook 227, 228, 229, 230, configured to hold attachment means 37 having the form of an upper loop 41 of a strap 34. The attachment means 37 comprise, preferably embedded in the loop 41, a reference object 8 in the form of a magnet.

Each holding means 227, 228, 229, 230 comprises sensing means 7 connected to the control unit 9, and the sensing means 7 are configured to cooperate with a respective reference object 8 in a manner corresponding to the previously described embodiment.

Figure 8:
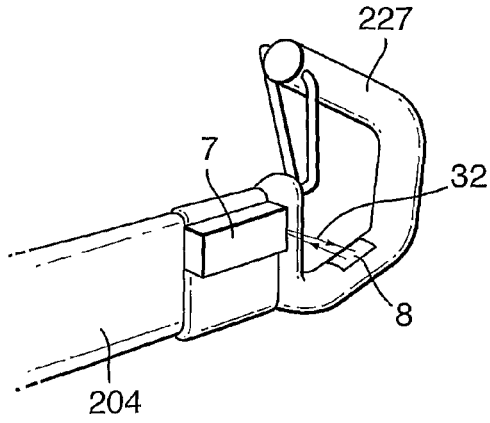
FIG. 8 is a perspective view of sensing means and reference object.

With reference to FIG. 8 illustrating an embodiment of the sensing means 7, the sensing means 7 are mounted on the arm 204 and comprises a light emitter and a light sensor (not shown). The light emitter emits a ray of light 32 towards a reflective reference object 8 of the surface of an inner, lower part of the hook 227. The reference object 8 reflects the ray of light 32 towards the light sensor. When a strap is positioned in the hook 227 it covers the reference object 8 resulting in the light sensor not detecting the reflected ray of light 32, since a strap made of fiber does not properly reflect the ray of light 32. When the reflected ray of light 32 is not detected, this is interpreted by the control unit 9 as the attachment means 37 being properly connected to the hook 227.

The sensing means and the reference object may in combination be any of a light sensor and light reflector, a sound sensor and sound reflector, an electronic receiver and transponder, or any other suitable sensor and sensing object. Of course, the reference object may be any object interfering with a magnetic field, if the sensing means is a magnetic field generator/monitor. The reference object may also be an active or passive RFID-tag, in which case the sensing means are an RFID transceiver.

The number of attachment means and associated holding means must not necessarily be four, but may be any number suitable for providing a safe lifting operation.

Not all attachment means/holding means must necessarily be fitted with sensing means/a reference object, but preferably the ones that are crucial in terms of safety will be.

As described, it is possible to provide a hoist device in which the attachment means comprise a reference object and in which the holding means comprise sensing means. The opposite is, of course, also possible, i.e. that the holding means comprise the reference object and the attachment means comprise the sensing means.

The invention claimed is:

1. A hoist device for lifting persons, the hoist device including:

a. a hoist sling having a sling attachment thereon from which the hoist sling can be supported, the sling attachment having an aperture defined therein, b. a sling holder configured to hold the sling attachment of the hoist sling, the sling holder thereby supporting the hoist sling from the sling attachment with the aperture fitting over at least a portion of the sling holder, c. a reference object included on one of the sling attachment and the sling holder, d. a sensor included on one of the sling attachment and the sling holder, wherein the sensor:

(1) detects the presence of the reference object, and (2) provides an output signal indicative of proper sling installation when the sling attachment and the sling holder are connected with the sling holder stably holding the sling attachment.

2. The hoist device of claim 1 wherein the sensor is included on:

a. the sling holder, if the reference object is included on the sling attachment, or b. the sling attachment, if the reference object is included on the sling holder.

3. The hoist device of claim 1 wherein the sling attachment includes a strap extending from the hoist sling, wherein the aperture is defined in the strap.

4. The hoist device of claim 3 wherein the reference object is included on the strap of the sling attachment.

5. The hoist device of claim 1:

a. wherein the reference object is formed of a material different from any material forming the adjacent areas of the sling attachment or the sling holder to which the reference object is attached, b. further including a control unit which:

(1) activates a warning signal, and/or (2) restrains raising and lowering of the sling holder, in the absence of the output signal from the sensor indicative of proper sling installation.

6. The hoist device of claim 1 further including a control unit which provides at least one of a visual or audible warning signal in the absence of the output signal from the sensor indicative of proper sling installation.

7. The hoist device of claim 1 further including a control unit which:

a. actuates raising and lowering of the sling holder, and b. restrains raising and lowering of the sling holder in the absence of the output signal from the sensor indicative of proper sling installation.

8. The hoist device of claim 1 wherein:

a. the sling holder is included on a sling hanger, and b. the sling hanger is raisable and lowerable by a user to thereby raise and lower any hoist sling held on the sling holder.

9. The hoist device of claim 8 wherein the sling hanger is restrained from being raised or lowered unless the sensor detects the reference object.

10. The hoist device of claim 1 wherein:

a. the sensor includes a magnetic field sensor, and b. the reference object includes a magnet.

11. The hoist device of claim 1 wherein:

a. the sensor includes an optical sensor, and b. the reference object includes a surface detectable by the optical sensor.

12. The hoist device of claim 3 wherein the sensor is included on:

a. the sling holder, if the reference object is included on the sling attachment, or b. the sling attachment, if the reference object is included on the sling holder.

13. The hoist device of claim 3:

a. wherein the reference object is formed of a material different from any material forming the adjacent areas of the sling attachment or the sling holder to which the reference object is attached, b. further including a control unit which:

(1) activates a warning signal, and/or (2) restrains raising and lowering of the sling holder, in the absence of the output signal from the sensor indicative of proper sling installation.

14. The hoist device of claim 3 further including a control unit which provides at least one of a visual or audible warning signal in the absence of the output signal from the sensor indicative of proper sling installation.

15. The hoist device of claim 3 further including a control unit which:

a. actuates raising and lowering of the sling holder, and b. restrains raising and lowering of the sling holder in the absence of the output signal from the sensor indicative of proper sling installation.

16. The hoist device of claim 3 wherein:

a. the sling holder is included on a sling hanger, and b. the sling hanger is raisable and lowerable by a user to thereby raise and lower any hoist sling held on the sling holder.

17. The hoist device of claim 16 wherein the sling hanger is restrained from being raised or lowered unless the sensor detects the reference object.

18. The hoist device of claim 3 wherein:

a. the sensor includes a magnetic field sensor, and b. the reference object includes a magnet.

19. The hoist device of claim 3 wherein:

a. the sensor includes an optical sensor, and b. the reference object includes a surface detectable by the optical sensor.

20. The hoist device of claim 4:

a. wherein the reference object is formed of a material different from any material forming the adjacent areas of the sling attachment or the sling holder to which the reference object is attached, b. further including a control unit which:

(1) activates a warning signal, and/or (2) restrains raising and lowering of the sling holder, in the absence of the output signal from the sensor indicative of proper sling installation.

* * * * *